US007234275B1

(12) United States Patent
Haggy et al.

(10) Patent No.: US 7,234,275 B1
(45) Date of Patent: Jun. 26, 2007

(54) BARRIER AND BARRIER SYSTEM

(75) Inventors: Christine M. Haggy, Pickerington, OH (US); John W. Marr, Jr., Columbus, OH (US)

(73) Assignee: Safety by Design, Ltd., Columbus, OH (US)

( * ) Notice: Subject to any disclaimer, the term of this patent is extended or adjusted under 35 U.S.C. 154(b) by 228 days.

(21) Appl. No.: 10/324,424

(22) Filed: Dec. 20, 2002

Related U.S. Application Data

(60) Provisional application No. 60/367,923, filed on Mar. 27, 2002.

(51) Int. Cl.
*E04F 13/04* (2006.01)
*E04H 17/08* (2006.01)

(52) U.S. Cl. ..... 52/71; 256/26; 160/135; 404/6

(58) Field of Classification Search ..... 404/6, 404/9; 256/24–27, 13.1, 73; 52/71, 103, 52/64, 574, 36.1, 581; 160/135; 403/339–341, 403/364, 387
See application file for complete search history.

(56) References Cited

U.S. PATENT DOCUMENTS

| | | | | | |
|---|---|---|---|---|---|
| 913,075 | A | | 2/1909 | Villard | |
| 1,071,283 | A | | 8/1913 | Weaver | |
| 1,167,746 | A | * | 1/1916 | Funsten | 52/574 |
| 1,527,684 | A | * | 2/1925 | Hull | 52/574 |
| 1,696,992 | A | * | 1/1929 | Whitacre | 52/569 |
| 1,719,620 | A | * | 7/1929 | Oesterla | 52/574 |
| 1,870,285 | A | | 8/1932 | Feldman | |
| 1,883,586 | A | * | 10/1932 | Corrington | 403/331 |
| 2,011,528 | A | | 8/1935 | Seay | |
| 2,247,614 | A | * | 7/1941 | Lingenfelter | 52/574 |
| 2,290,369 | A | * | 7/1942 | Fleischmann | 52/574 |
| 2,602,643 | A | | 7/1952 | Caldwell, Jr. | |
| 2,736,041 | A | | 2/1956 | Maloof | |

(Continued)

FOREIGN PATENT DOCUMENTS

DE 4320720 A1 * 12/1994 ..... 256/13.1

OTHER PUBLICATIONS

Bureau of Location and Design, Ohio Department of Transportation, *32" Portable Concrete Barrier*, Standard Construction Drawing MC-9.2.

(Continued)

*Primary Examiner*—Tamara L. Graysay
(74) *Attorney, Agent, or Firm*—David E. Pritchard

(57) ABSTRACT

One version of the barrier system may include a first barrier and a second barrier, in which each of the first and second barriers may have a support structure and an upwardly-extending structure. In addition, the first barrier may have a retaining structure adapted to facilitate retention of a portion of the upwardly-extending structure of the second barrier when one of the first and second barriers is in an inverted position. This inverted orientation may be especially advantageous when storing a pair of barriers. For example, in such an orientation, the barrier-pair may occupy less floor- or ground-space than two such barriers placed side-by-side. Moreover, depending on the height of the particular storage area, a second pair of similarly inverted barriers may be securely placed on top of the first pair. In this fashion, the barriers occupy relatively little storage space, space which typically is quite limited and therefore valuable.

33 Claims, 5 Drawing Sheets

U.S. PATENT DOCUMENTS

| | | | | | |
|---|---|---|---|---|---|
| 2,792,704 | A | * | 5/1957 | Kooiman | 52/503 |
| 2,884,780 | A | * | 5/1959 | Ramirez | 52/570 |
| 2,895,717 | A | | 7/1959 | De Falco | |
| 3,418,774 | A | * | 12/1968 | Kocher et al. | 52/437 |
| 4,040,759 | A | * | 8/1977 | Skalle | 404/6 |
| 4,371,285 | A | * | 2/1983 | Behar | 403/339 |
| 4,638,617 | A | * | 1/1987 | James | 52/474 |
| 4,681,302 | A | | 7/1987 | Thompson | |
| 4,712,773 | A | | 12/1987 | Larson | |
| 5,011,325 | A | * | 4/1991 | Antonioli | 404/6 |
| 5,022,781 | A | * | 6/1991 | Smith | 404/6 |
| 5,074,705 | A | * | 12/1991 | Schmitt | 404/6 |
| 5,081,723 | A | | 1/1992 | Saunders | |
| 5,118,216 | A | * | 6/1992 | Smith | 404/6 |
| 5,123,773 | A | * | 6/1992 | Yodock | 404/6 |
| 5,186,438 | A | | 2/1993 | Cross et al. | |
| 5,208,585 | A | * | 5/1993 | Sprague | 404/6 |
| 5,356,119 | A | | 10/1994 | Schock | |
| 5,371,982 | A | * | 12/1994 | Douglas et al. | 52/64 |
| 5,382,111 | A | | 1/1995 | Melashenko et al. | |
| 5,394,927 | A | | 3/1995 | Huebner | |
| 5,402,999 | A | | 4/1995 | Keehn, Sr. | |
| 5,407,178 | A | | 4/1995 | Long | |
| 5,425,594 | A | * | 6/1995 | Krage et al. | 404/6 |
| 5,498,101 | A | * | 3/1996 | Braverman | 404/6 |
| 5,544,870 | A | | 8/1996 | Kelley et al. | |
| 5,609,327 | A | | 3/1997 | Amidon | |
| D400,264 | S | | 10/1998 | Striefel et al. | |
| 5,836,714 | A | | 11/1998 | Christensen | |
| 5,882,140 | A | * | 3/1999 | Yodock et al. | 404/6 |
| 5,967,214 | A | * | 10/1999 | Beretta | 160/135 |
| 6,027,104 | A | | 2/2000 | Alexander et al. | |
| D422,367 | S | | 4/2000 | Mishina | |
| 6,059,268 | A | | 5/2000 | Santelli, Jr. | |
| 6,059,491 | A | | 5/2000 | Striefel et al. | |
| 6,061,972 | A | * | 5/2000 | Thorp | 52/36.1 |
| 6,086,285 | A | * | 7/2000 | Christensen | 404/6 |
| 6,105,654 | A | * | 8/2000 | Martel | 160/135 |
| 6,119,288 | A | | 9/2000 | Hendrickson | |
| D443,698 | S | | 6/2001 | Kazakidis | |
| 6,257,559 | B1 | | 7/2001 | Mouri | |
| 6,301,831 | B1 | | 10/2001 | Condy et al. | |
| 6,357,462 | B1 | | 3/2002 | Laosunthara et al. | |
| 6,413,009 | B1 | * | 7/2002 | Duckett | 404/6 |
| 2002/0014619 | A1 | | 2/2002 | Christensen | |
| 2002/0025221 | A1 | * | 2/2002 | Johnson | 404/6 |

OTHER PUBLICATIONS

Bureau of Location and Design, Ohio Department of Transportation, *50 Inch Portable Concrete Barrier*, Standard Construction Drawing MC-9.1.

Playfence Inc., *With Your Child's Safety in Mind Portable Fence*, <URL: http:/222.playfence.com/portablefence.htm>, pp. 1-2. Jun. 17, 2002.

Farm Goods for Kids, *Driveway Barrier by Sport-Fun*, URL: http://www.farmgoodsforkids.com> p. 1.

* cited by examiner

BARRIER AND BARRIER SYSTEM

CROSS-REFERENCE TO RELATED APPLICATION

This patent document claims the benefit of the filing date of Provisional U.S. Patent Application No. 60/367,923 entitled "Barrier Wall System" and filed on Mar. 27, 2002. The entire disclosure of that provisional U.S. patent application is incorporated into this non-provisional U.S. patent document by reference.

BACKGROUND OF THE INVENTION

1. Field of the Invention

This invention is directed to barriers, and in particular, to relatively-lightweight, portable barriers which may be used in any of a number of situations, such as, for example, children's play areas, crowd-control areas, and roadway construction areas.

2. Description of the Related Art

Existing products for use in establishing children's play areas include nets which may be strung across driveways, see-through mesh held up by metal supports anchored in the ground, "caution" screens placed at the edge of play areas, low-profile deflector strips laid across a driveway, and multi-panel playpens in which the playpen panels are made of net-like plastic, wooden dowels, or the like.

Although these products may offer certain benefits, each of the products has one or more limitations or drawbacks. For example, the netting and see-through mesh are not freestanding, and therefore, require the use of guy-wires and stakes, poles driven into the ground, or moveable pole/pole-stand assemblies. Although the "caution" signs are free-standing, such signs may be moved by children, thereby defeating the cautionary purpose of the signs. Low-profile deflector strips, positioned across a driveway, are intended to prevent a small ball or the like from rolling out into a street. However, because the deflector strips have such a low profile, they may not be seen by children or unsuspecting drivers. Moreover, children may trip on the deflector strips. With regard to the playpens described above, one of their benefits is that they are extremely lightweight. However, because they are lightweight, they may be knocked over by children, house pets, and even unsuspecting adults.

SUMMARY OF THE INVENTION

The present invention overcomes the above-mentioned limitations and drawbacks by providing a barrier and barrier system which are not only sturdy, freestanding, and highly-visible, but which are also relatively lightweight, portable, and compact. To this end, and in accordance with the principles of the invention, one aspect of the invention is directed to a first barrier which may include a support structure, an upwardly-extending structure, and a retaining structure. The retaining structure may be adapted to facilitate retention of a portion of an upwardly-extending structure of a second barrier when one of the first and second barriers is in an inverted position, the second barrier including a support structure and the upwardly-extending structure. As used in this patent document, the term "barrier" refers, without limitation, to a barrier unit, as well as to a gate unit, both of which are discussed in further detail in the "Detailed Description of the Drawings" section below.

Another aspect of the invention is directed to a barrier system. The barrier system may have at least a first barrier and a second barrier, in which each of the first and second barriers may have a support structure and an upwardly-extending structure. In addition, the first barrier may have a retaining structure. This retaining structure may be adapted to facilitate retention of a portion of the upwardly-extending structure of the second barrier when one of the first and second barriers is in an inverted position. When the first and second barriers are positioned in such an orientation, they may be said to be in a "nested" orientation or position. As used in this patent document, the term "nested" refers to an arrangement of a pair of barriers, in which: at least a portion of an upwardly-extending structure of one barrier is adjacent at least a portion of an upwardly-extending structure of the other barrier; one of the barriers is in an inverted position relative to the other barrier; and at least a part of the retaining structure of one barrier facilitates retention of an upper portion of the upwardly-extending structure of the other barrier.

These aspects offer several benefits and advantages to a user. For example, if one of the barriers is oriented in an inverted position, the portion of the upwardly-extending structure of the other barrier may be retained by the retaining structure of the inverted barrier. This inverted orientation may be especially advantageous when storing a pair of barriers. For example, in such an orientation, the barrier-pair may occupy less floor- or ground-space than two such barriers placed side-by-side. Moreover, depending on the height of the particular storage area, a second pair of similarly inverted barriers may be securely placed on top of the first pair. In this fashion, the barriers occupy relatively little storage space, space which typically is quite limited and therefore valuable.

If desired, the retaining structure of the first barrier may include at least one tab. The tab and at least one of the support structure and the upwardly-extending structure of the first barrier may define a space therebetween. In this manner, the portion of the upwardly-extending structure of the second barrier may be received in the space of the first barrier. The second barrier also may include a retaining structure, whereby a portion of the upwardly-extending structure of the first barrier may be retained by the retaining structure of the second barrier when one of the first and second barriers is in an inverted position. If desired, the retaining structure of the second barrier may include at least one tab. This tab and at least one of the support structure and the upwardly-extending structure of the second barrier may define a space therebetween. In this fashion, the portion of the upwardly-extending structure of the first barrier may be received in the space of the second barrier.

In another aspect, the space of the first barrier has a width, and the portion of the upwardly-extending structure of the second barrier may have a thickness which is substantially similar to the width of the space of the first barrier. In addition, when the second barrier includes a tab, the portion of the upwardly-extending structure of the first barrier may have a thickness which is substantially similar to the width of the space of the second barrier.

In a further aspect, the retaining structure of the first barrier may include a groove, whereby a portion of the upwardly-extending structure of the second barrier may be received in the groove when one of the first and second barriers is in an inverted position. Also, if the second barrier is provided with a retaining structure, this retaining structure likewise may include a groove, whereby a portion of the upwardly-extending structure of the first barrier may be received in the groove of the second barrier when one of the first and second barriers is in an inverted position.

In yet another aspect, the support structure, upwardly-extending structure, and/or retaining structure of the first- and/or second-barrier(s), respectively, may be integrally connected. Alternatively, the support structure, upwardly-extending structure, and/or retaining structure of the first- and/or second-barrier(s), respectively, may be releasably connectable. For example, if the support structure and upwardly-extending structure of the first barrier are releasably connectable, one of the support structure and the upwardly-extending structure of the first barrier may have a tongue, and the other of the support structure and the upwardly-extending structure of the first barrier may have a corresponding groove, thereby facilitating their releasable connection.

In an additional aspect, at least one of the first and second barriers may have an interior chamber. Such an interior chamber may have an opening which provides access to the interior chamber, thereby enabling a user to put a ballast material (for example, sand or water) in the interior chamber, or to remove such a material from the interior chamber. Also, a removable, yet resealable, cap may be provided for each such opening. In this fashion, a user may increase or decrease the effective weight of one or more of the barriers as desired, in order to suit a given use at a particular time.

In yet a further aspect, the upwardly-extending structure of the first and second barriers may have a first sidewall and an oppositely-disposed second sidewall. The upwardly-extending structure of at least one of the first and second barriers may further have at least one opening which extends from the first sidewall to the second sidewall. This particular feature offers several benefits. For example, the opening may serve as a "window", thereby enabling a child or adult to see through that portion of the particular barrier. The opening also may reduce the weight of the barrier in the region of the opening, thereby further enhancing the portability of the barrier. And if the window is positioned in an upper region of the upwardly-extending structure, then more of the barrier's weight may be oriented lower in the barrier, thereby maintaining or enhancing the overall stability of the barrier.

In another aspect, each of the first and second barriers has an end, and these ends may be releasably connected to each other. If desired, a hinge pin may be used to releasably connect the first barrier end to the second barrier end. In a further aspect, the barrier system may include a third barrier, and the barriers may be adapted to be releasably connected to each other. In this fashion, if desired, the barriers may be arranged to form an enclosure.

The barrier(s) may include other features as well. For example, one or more of the barriers may include a wheel and/or a handle, thereby facilitating movement of the barrier (s) from one location to another location. Also, if a barrier has a bottom wall, the bottom wall may include at least one section having an increased coefficient of friction. If desired, this section may be releasably connected to the bottom wall.

In yet a further aspect, the barrier and/or barrier system may include a first mounting bracket, with the first mounting bracket adapted to releasably connect at least one of the barriers to a first portion of a vertical support surface. In addition, the barrier system may include a second mounting bracket, with the second mounting bracket adapted to releasably connect at least one of the barriers to a second portion of the vertical support surface. If desired, the first portion may be a wall, and the second portion may be another wall.

While several benefits and advantages of the invention have been described briefly above, additional benefits and advantages will become apparent from a reading of the "Detailed Description of the Drawings" section presented below.

BRIEF DESCRIPTION OF THE DRAWINGS

The accompanying drawings, which are incorporated in, and constitute a part of, this specification, illustrate a few exemplary versions of the invention, and, together with the general description of the invention given above, and the detailed description of the drawings given below, serve to explain the principles of the invention.

DETAILED DESCRIPTION OF THE DRAWINGS

Figure 1:
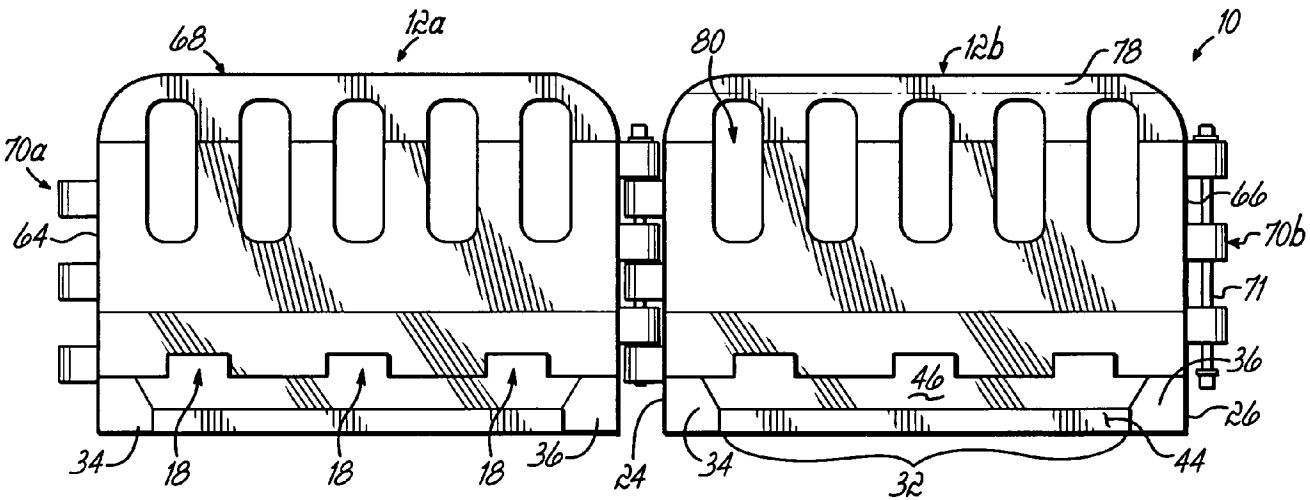
FIG. 1 is a side elevational view of a version of the barrier system, in which two barrier units are releasably connected together.

As shown in FIGS. 1–4, one version 10 of the barrier and barrier system includes a first barrier in the form of a first barrier unit 12*a*, and a second barrier in the form of a second barrier unit 12*b*. Each of the units 12*a,b* includes a support structure in the form of a platform 14, an upwardly-extending structure in the form of a wall 16, and a retaining structure in the form of a series of tabs 18. The tabs 18 of each unit 12*a,b* assist in retaining a portion of the wall 16 of the corresponding unit 12*a,b* when one of the units 12*a,b* is in an inverted position. Note that the units 12*a,b* are identical, and that any one or more of them also may be identified by the reference number 12.

The platform 14 is integrally connected to the wall 16, and includes a first sidewall 20, an oppositely-disposed second sidewall 22, a left end wall 24, a right end wall 26, a top wall 28, and a bottom wall 30. The first sidewall 20 includes an elongated section 32, a first beveled section 34 between the elongated section 32 and the left end wall 24, and a second beveled section 36 between the elongated section 32 and the right end wall 26. In similar fashion, the oppositely-disposed second sidewall 22 includes an elongated section 38, a first beveled section 40 between the elongated section 38 and the left end wall 24, and a second beveled section 42 between the elongated section 38 and the right end wall 26.

Figure 2:
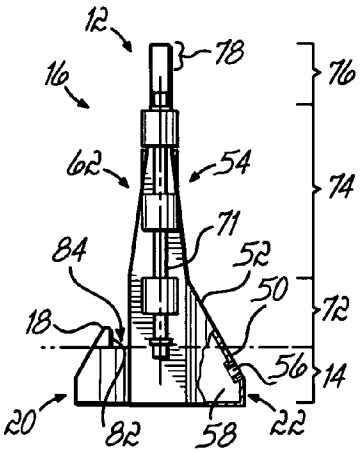
FIG. 2 is a partially-broken-away end elevational view of a barrier unit of FIG. 1.
Figure 4:
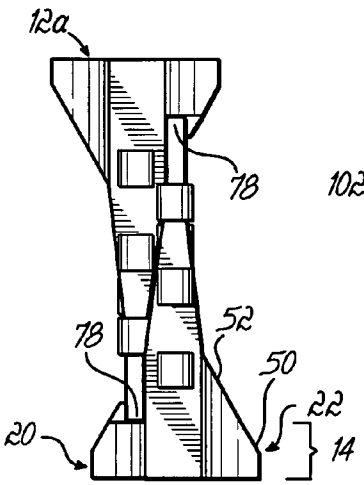
FIG. 4 is an end elevational view of the barrier units shown in FIG. 3.

The platform 14 is described in further detail immediately below. Moving upward from the bottom wall 30 of the platform 14, the elongated section 32 of the first sidewall 20 has a vertical surface 44 connected to a tapered surface 46. The tapered surface 46 has a uniform taper, and extends to the top wall 28. The elongated section 38 of the second sidewall 22 likewise has a vertical surface 48 connected to a tapered surface 50. However, this tapered surface 50 is somewhat different from the tapered surface 46 of the first sidewall 20. Although the second-wall tapered surface 50 has a uniform taper, this surface 50 does not extend to the top wall 28. Instead, the tapered surface 50 meets the tapered surface 52 of the oppositely-disposed second sidewall 54 of the wall 16, as discussed in detail below (FIGS. 2 and 4). The first and second beveled sections 34, 36, 40, 42 of the platform sidewalls 20, 22 have vertically-oriented surfaces, as do the left and right end walls 24, 26. In addition, both the top wall 28 and the bottom wall 30 are planar.

The construction and arrangement of the beveled sections 34, 36, 40, 42 enable a pair of pivotably connected barriers to pivot through an entire range of angles. This range may be further enhanced by the construction and arrangement of the pivotable loop connectors 70 (discussed in further detail below). The wide range of angles enables a user to assemble the barriers in any of a number of useful orientations, so as to best meet the particular need or situation. For example, the barrier units 12*a,b* of the particular version 10 of the barrier system shown in FIGS. 1–4 may be pivoted through an impressive 270° relative to each other.

Figure 6:
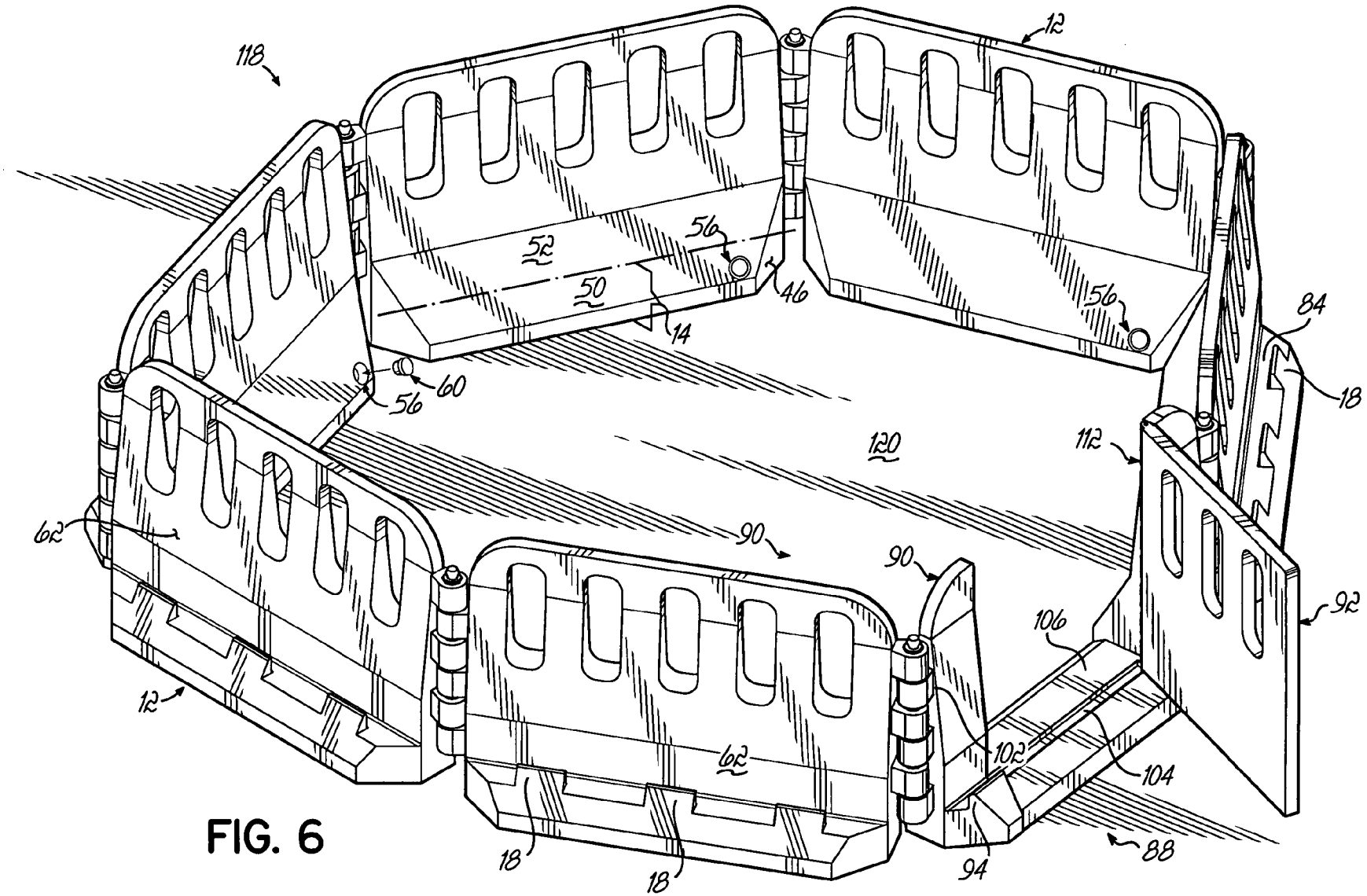
FIG. 6 is a perspective view of another version of the barrier system arranged to form an enclosed play area.

As seen in FIG. 2, the second sidewall 22 of the platform 14 has an opening, in the form of a fill port 56, which provides access to an interior chamber 58 of the barrier unit 12. In this fashion, if desired, a user may increase (or decrease) the weight of a barrier unit 12 by adding (or removing) sand, water, or some other ballast material to (from) the interior chamber 58. As shown in FIG. 6, each barrier unit 12 further includes a removable and resealable cap 60 for closing the corresponding fill port 56.

The wall 16 includes a first sidewall 62, an oppositely-disposed second sidewall 54, a left end wall 64, a right end wall 66, and a top wall 68. As best seen in FIG. 1, the left and right end walls 64, 66 are vertical, and the top wall 68 is horizontal, with the junction of the top wall 68 and each of the end walls 64, 66 being an arcuate, smooth curve having a constant radius of curvature. Each of the left and right end walls 64, 66 has a series of three coaxially-aligned loop connectors 70, oriented and sized to receive a hinge pin. The left end wall loop connectors 70*a* are lower than the right end wall loop connectors 70*b*. In this fashion, the barrier units 12 may be aligned end-to-end, with the three left end wall loop connectors 70*a* of one of the units 12 occupying the space between the right end wall loop connectors 70*b* of an adjacent one of the units 12, thereby forming a series of coaxially-aligned bores capable of receiving a hinge pin. The particular version 71 of a hinge pin shown in the Figures includes a rod, a top member having a flange, and a bottom member having a flange. If desired, the hinge pin may be constructed so that one or both of the top and bottom members may be removed from, and reattached to, the rod of the hinge pin.

As seen in FIG. 2, the wall 16 also may be viewed as having a lower portion 72, a middle portion 74, and an upper portion 76, with the upper portion 76 including a top portion 78. With reference to the first sidewall 62 of the wall 16, the lower portion 72 is vertical, the middle portion 74 tapers at a uniform angle, and the upper portion 76 is vertical. With regard to the oppositely-disposed second sidewall 54, the lower portion 72 has a first uniform taper, the middle portion 74 has a second uniform taper, and the upper portion 76 is vertical.

The wall 16 also has a series of openings in the form of through-holes 80, which extend from the first sidewall 62, through the wall 16 to the second sidewall 54. In further detail, these through-holes 80 are vertically oriented, extending from about halfway up the middle portion 74 of the wall 16 to a little more than halfway up the upper portion 76. These through-holes 80 provide several benefits to a user. For example, they reduce the overall weight of the barrier units 12, thereby making it even easier for a user to move a unit 12 from one place to another. Moreover, because they are located in the upper half of the barrier units 12, they do not detract from the stability of the units 12. In fact, if the version 10 of the barrier and barrier system is used in an environment where the barrier units 12 are subject to wind (for example, natural wind, or wind generated by vehicles moving past the barriers on a roadway), the through-holes 80 further enhance the stability of each unit. Rather than exerting a force against a large, upright, planar surface, much of the wind is able to pass through the through-holes 80 of each barrier unit 12. The through-holes 80 provide another benefit in that they may serve as "windows". For example, a toddler may look through the windows to see what is happening on the other side of a barrier unit 12. In like fashion, a parent or other supervising adult may look through the windows to assist in monitoring the activities of a toddler on the other side of a barrier unit 12.

The tabs 18 are integrally connected to the top wall 28 of the platform 14. In further detail, the tabs 18 are aligned in a row along the top wall 28, adjacent the tapered surface 46 of the first-sidewall elongated section 32. Each tab 18 has a surface 82 which is distanced slightly from the first sidewall 62 of the wall 16. This tab surface 82, in combination with an opposing surface of the first sidewall 62 and the surface of the top wall 28 which is positioned between the two, forms a channel which defines a space 84. Accordingly, each barrier wall unit 12 has a series of three such channel spaces 84. In this fashion, at least a part of the top portion 78 of a wall 16 of one barrier unit 12 may be releasably received in at least one of the channel spaces 84 of another barrier unit 12, when one of the two units 12 is oriented in an inverted position. Advantageously, the top portion 78 of a wall 16 of one unit 12 is received in all three of the channel spaces 84 of another unit 12. While not required, this alignment and orientation provide for a more compact nesting arrangement between two barrier units 12.

Figure 3:
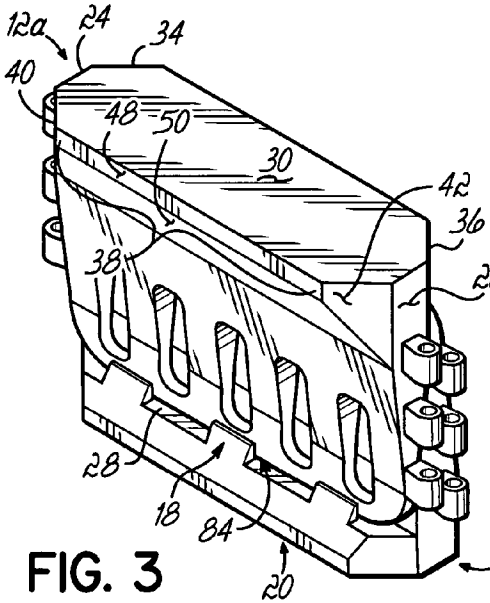
FIG. 3 is a perspective view of the barrier units of FIG. 1, with the barrier units shown in a particular nested position.

FIGS. 3 and 4 depict one example of such an arrangement, with the barrier units 12*a,b* in a secure, yet releasable, nested position. In further detail, the first barrier unit 12*a* is inverted, and the top portion 78 of the wall 16 of the unit 12*a* is securely, yet releasably, received in the channel spaces 84 of the second barrier unit 12*b*. At the same time, the top portion 78 of the wall 16 of the second barrier unit 12*b* is securely, yet releasably, received in the channel spaces (not shown) of the first barrier unit 12*a*. This nesting feature offers several benefits and advantages for a user. For example, if the barrier units 12*a,b* are in a nested position, they require less storage space than if they are arranged side-by-side in an upright position. Also, because the barrier units 12*a,b* are releasably, yet securely, fitted together, the bottom wall 30 of the platform 14 of the inverted unit 12*a* may serve as a support surface on which another pair of nested barriers (not shown) may be stacked.

Figure 5:
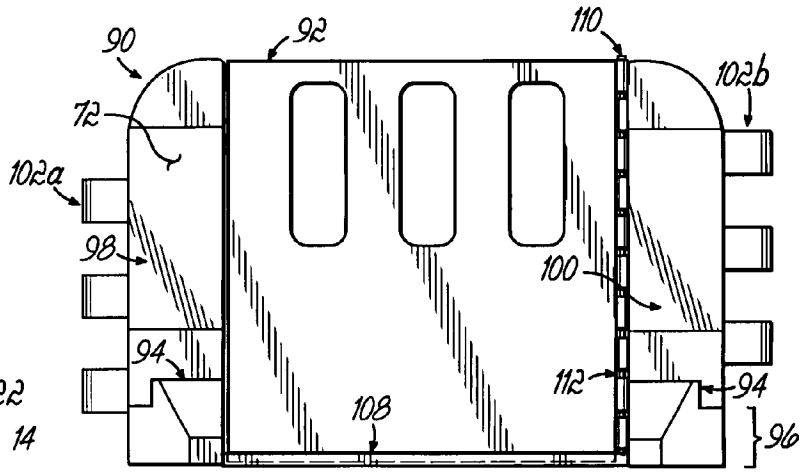
FIG. 5 is a side elevational view of a version of the barrier, in which the barrier is a gate unit.

As shown in FIG. 5, another version of the barrier includes a gate unit 88. The gate unit 88 is made up of a gate frame 90 and a gate door 92 which is pivotably connected to the gate frame 90. The profile of the gate frame 90 is quite similar to that of the barrier units 12. For example, the gate frame 90 has a height and length which are similar to that of the barrier units 12. In addition, the gate frame 90 includes a pair of tabs 94 similar to the tabs 18 of the barrier units 12. These features are particularly beneficial, in that a user may take advantage of the same nesting capability which exists with two barrier units 12, as described above. For example, a user may create a nesting pair, either with a gate unit 88 and a barrier unit 12, or with two gate units 88.

In further detail, the gate unit 88 includes a support surface in the form of a platform 96, and an upwardly-extending structure in the form of a left-end wall 98 and a right-end wall 100. The left-end and right-end walls 98, 100 are integrally connected to the platform 96, as best seen in FIG. 5. Each of the walls 98, 100 has a series of loop connectors 102, with the connectors 102*a* similar to the barrier connectors 70*a*, and the connectors 102*b* similar to the barrier connectors 70*b*. In this fashion, a gate unit 88 may be pivotably attached to an adjacent barrier unit 12 and/or gate unit 88 if desired.

The platform 96 includes a groove 104 (FIG. 6) formed in the top wall 106 (FIG. 6) of the platform 96, with the groove 104 adapted to receive a lower portion 108 of the gate door 92 when the gate door 92 is in a closed orientation (FIG. 5). The gate unit 88 also includes a hinge 110 which enables the gate door 92 to be opened outwardly through an angle of about 90°, as well as inwardly through an angle of about 90°. The hinge 110 includes hinge barrels on the gate-frame right-end wall 100 and on the gate-door right sidewall 112. The hinge barrels are coaxially aligned, and a hinge pin is placed through the bores of the coaxially-aligned hinge barrels. The hinge 110 is designed so that a gap of sufficient vertical length exists between each of the hinge barrels, thereby enabling the gate door 92 to move downward, with the lower portion 108 releasably and securely fitting into the groove 104, when the gate door 92 is in a closed orientation relative to the gate frame 90. This feature is of tremendous benefit to a user. In particular, when the gate door 92 is closed, the groove 104 is biased against the lower portion 108 of the door 92, thereby keeping the door 92 in a closed position. In order for a user to open the door 92, the user must lift the door 92 straight up, relative to the gate frame 90, until the lower portion 108 of the door 92 clears the groove 104, at which point the user may move the gate door 92 into an open position.

Figure 7:
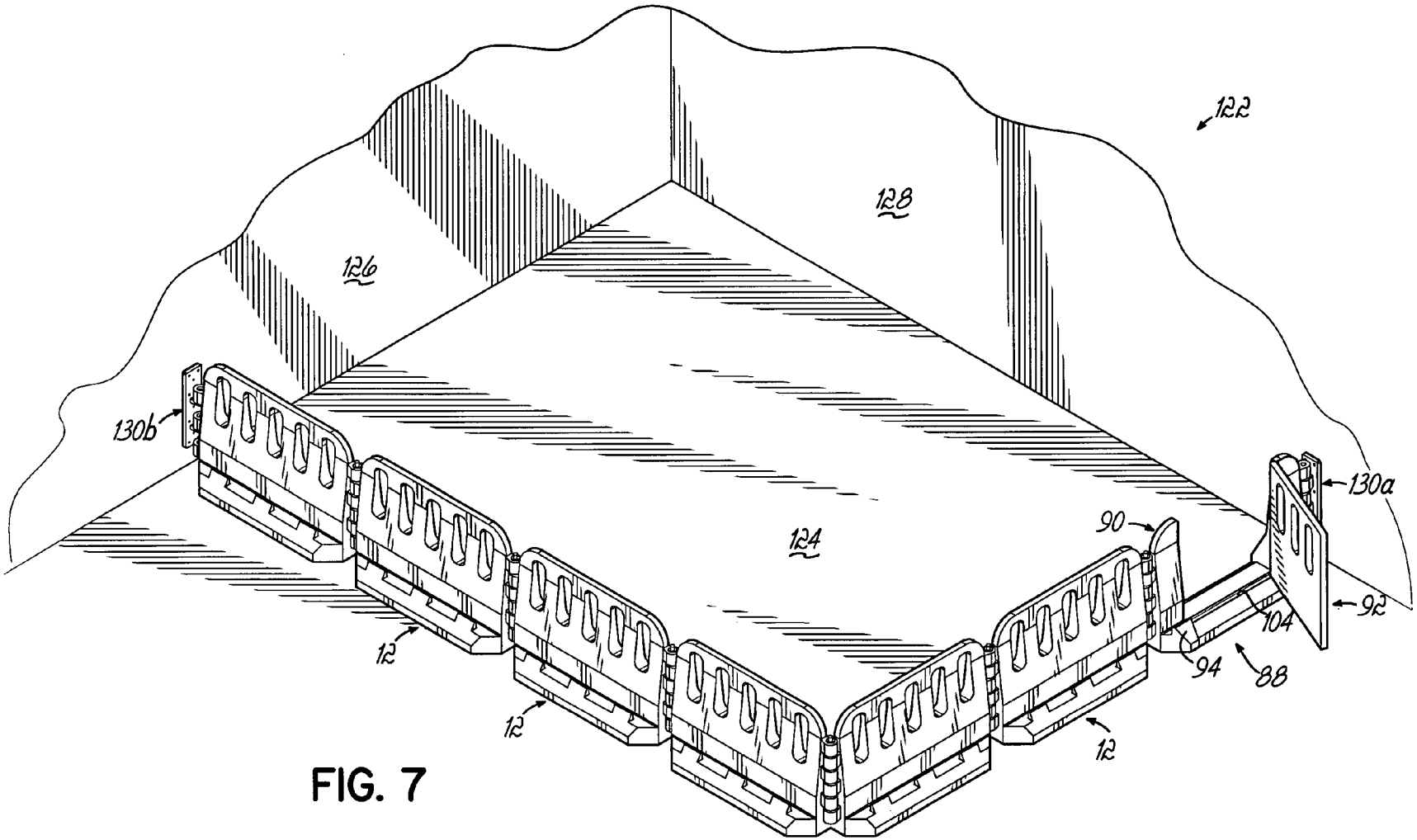
FIG. 7 is a perspective view of a further version of the barrier system mounted to two adjacent walls, thereby forming an enclosed play area.

FIGS. 6 and 7 show two further versions of the barrier system. In FIG. 6, an enclosure 118 is made up of several barrier units 12 pivotably connected to each other and to a gate unit 88, and is shown positioned on a supporting surface 120. In FIG. 7, an enclosure 122 is formed on a supporting surface 124, using barrier units 12 and a gate unit 88 in combination with a vertical support surface. The vertical support surface, in the form of a wall 126 and an adjacent wall 128, makes up two sides of the rectangular enclosure 122 shown; and the barrier units 12 and gate unit 88 form the other sides of the enclosure 122. The enclosure 122 also includes mounting brackets 130. These brackets 130 are mounted to the walls 126, 128, and the barrier units 12 and gate unit 88 are releasably connected to the brackets 130, thereby forming the enclosure 122.

Figure 8:
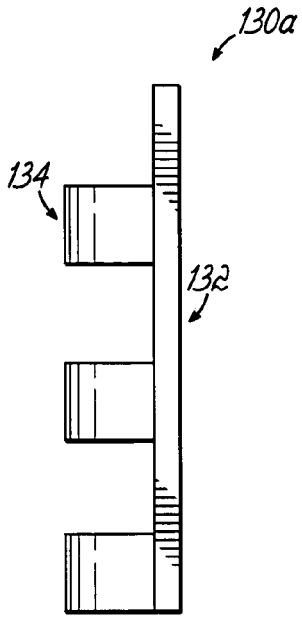
FIG. 8 is a side elevational view of a first version of the mounting bracket of the invention.
Figure 9:
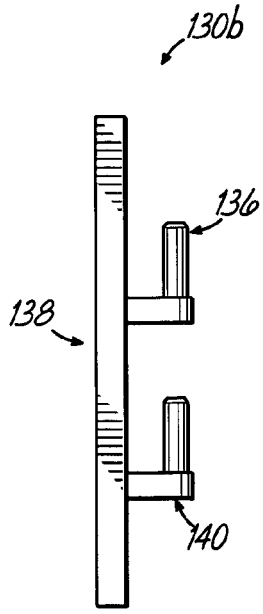
FIG. 9 is a side elevational view of a second version of the mounting bracket of the invention.

With reference to FIGS. 7–9, two versions 130*a,b* of the mounting bracket are shown. The mounting bracket 130*a* includes a mounting plate 132 and a series of three vertically- and coaxially-aligned loop connectors 134 which extend horizontally outward from the mounting plate 132. The loop connectors 134 are sized and positioned to be aligned with corresponding loop connectors 70, 102 on a barrier unit 12 or gate unit 88, and to receive the type of hinge pin 71 used to pivotably connect the barrier units 12 and gate units 88. (See the hinge pin 71 shown in FIGS. 1 and 2.) The other version 130*b* of the mounting bracket includes two vertically-oriented, coaxially-aligned posts 136, each of which is connected to a mounting plate 138 by a horizontal support member 140. These posts 136 are configured so that they may take the place of a hinge pin. Accordingly, a barrier unit 12 or gate unit 88 easily may be pivotably connected to the mounting bracket 130*b* by aligning the barrier-unit- or gate-unit-loop connectors 70, 102 with the posts 136, and lowering the particular barrier unit 12 or gate unit 88 so that the mounting-bracket posts 136 engage two of the three loop connectors 70, 102 on the barrier unit 12 or gate unit 88.

Figure 10:
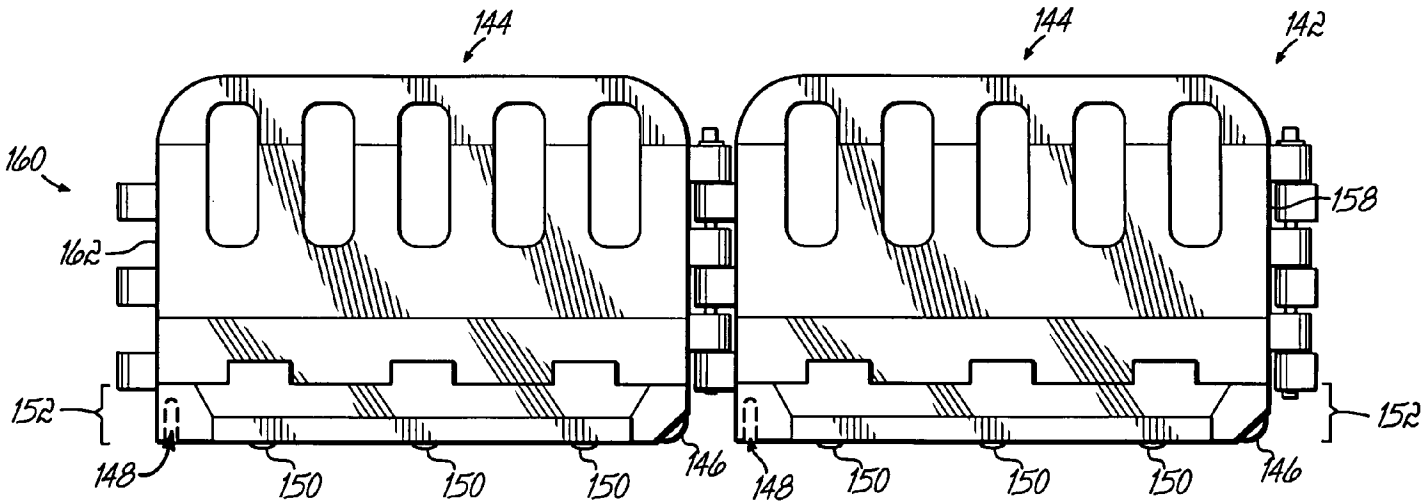
FIG. 10 is a side elevational view of another version of the barrier system, in which two barrier units are releasably connected together.
Figure 11:
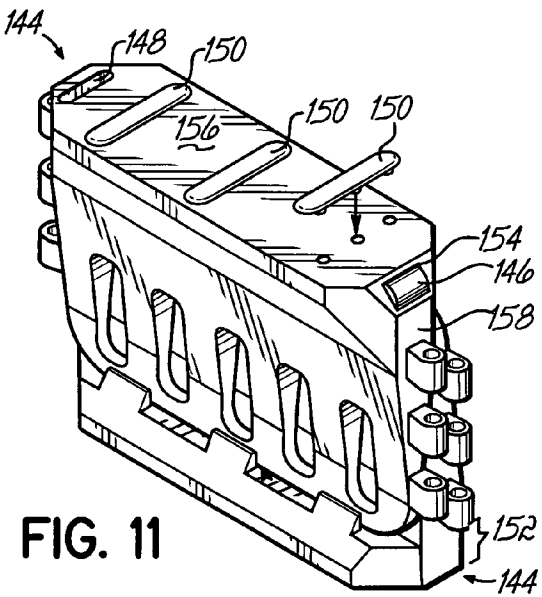
FIG. 11 is a perspective view of the barrier units of FIG. 10, with the barrier units shown in a particular nested position.

FIGS. 10 and 11 show another version 142 of the barrier and barrier system. This version 142 is substantially the same as the version 10 shown in FIGS. 1–4, with the following modifications. Each barrier unit 144 further includes a wheel 146, a handle 148, and a series of three removable anti-skid pads 150. The wheel 146 is positioned at the lower right corner of the barrier unit 144. In further detail, the platform 152 includes a beveled surface 154 which extends from the bottom wall 156 to the right end wall 158. This beveled surface 154 has a receptacle (not shown) into which a portion of the wheel 146, including the wheel's axle (not shown), is positioned. The wheel 146 and wheel receptacle are constructed and arranged so that the wheel 146 makes little, if any, contact with a horizontal support surface when the barrier unit 144 is in an upright horizontal portion (FIG. 10). If a user wants to move the barrier unit 144 using the wheel 146, the user may simply lift the left end 160 of the unit 144 to an appropriate height, and then pull or push the unit 144. The handle 148 is an elongated slot formed in the bottom wall 156 of the platform 152, adjacent the left end wall 162. The handle 148 is sized so that a user may insert several fingers into the slot, thereby providing a hand-hold from which to pull, push, or carry the barrier unit 144. If desired, a user may grasp any other suitable portion (s) of the barrier unit 144, in addition to, or instead of, the handle 148, when moving the unit 144. The anti-skid pads 150 are distributed across the platform bottom wall 156, perpendicular to the longitudinal axis of the barrier unit 144 (FIG. 11). In addition, the pads 150 may be detached from, and reattached to, the bottom wall 156, thereby giving a user the option to use/not use the pads 150, and to replace them if they become worn. The wheel 146 and pads 150 may be made of any suitable material or combination of materials. For example, the wheel 146 may be made of plastic and the anti-skid pads 150 may be made of a rubber composition.

Figure 12:
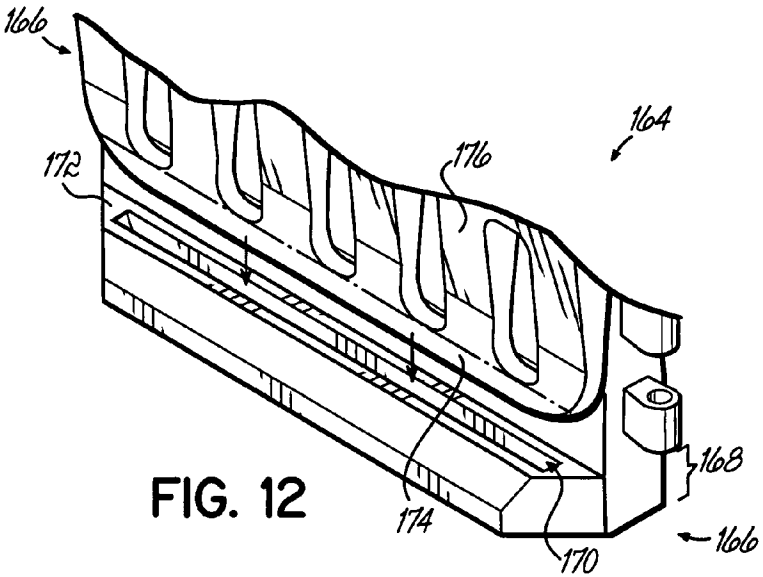
FIG. 12 is a partial perspective view of an additional version of the barrier and barrier system, with the barrier units in the process of being brought together in a particular nested position.

FIG. 12 depicts a further version 164 of the barrier and barrier system, in which the retaining structure of each barrier unit 166 is formed in the platform 168. In further detail, an elongated groove 170 is formed in the top wall 172 of each platform 168, with the elongated groove 170 of one barrier unit 166 sized to receive the upper portion 174 of the wall 176 of another unit 166.

Figure 13:
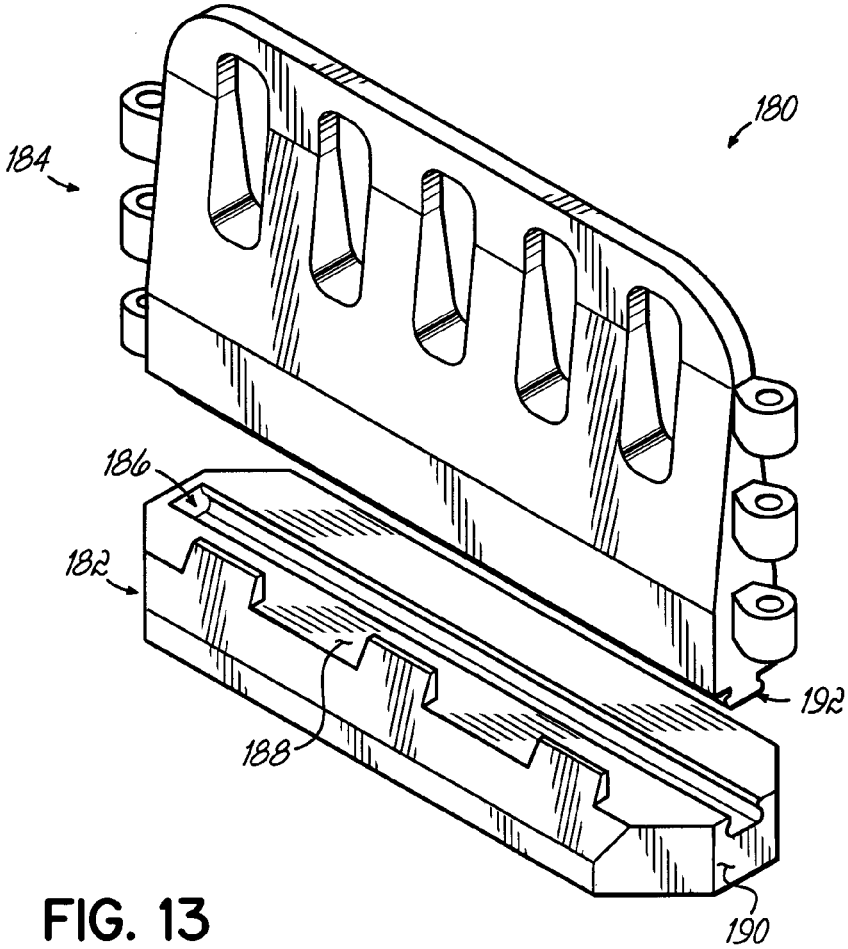
FIG. 13 is a disassembled perspective view of a further version of the barrier, in which the barrier is a barrier unit.

FIG. 13 illustrates another version of the barrier. This particular version is a two-piece barrier unit 180, with the platform 182 and the wall 184 making up the two pieces.

The platform 182 has a dovetail groove 186 formed in the top wall 188, with the groove 186 being open at one end 190. The wall 184 has a corresponding dovetail tab 192 at its base. In this fashion, the tab 192 may be releasably slid into the groove 186 from the open end 190, thereby forming the barrier unit 180.

The barrier and barrier system may be made using any suitable, commercially-available materials. For example, if desired, any one or more of the various components of the barrier and barrier system may be made of plastic. Also, if desired, any one or more of these components may be hollow and may have an access port. This aspect may be especially beneficial for a barrier unit and/or a gate unit, in that it enables a user to add a ballast material to the interior of a barrier unit or gate unit, as desired. With regard to manufacture, the components of the barrier and barrier system may be made using any suitable, commercially-available manufacturing technique or combination of techniques. For example, if desired, a barrier unit and a gate unit may be made using rotational molding.

The many ways in which the barrier and barrier system may be used are limited only by the imagination of the user. For example, depending upon the particular application, a single barrier unit and/or single gate unit may be all that is needed. Alternatively, any number of barrier units and/or gate units may be connected to one another, to form a barrier system having any of a number of different curves, patterns, or other configurations. Also, as may be appreciated from the enclosure 118 shown in FIG. 6, an enclosure may be formed solely using components of the barrier system. Alternatively, as may be understood from the enclosure 122 shown in FIG. 7, an enclosure may be formed using barrier-system components in combination with one or more vertical support surfaces (e.g. the walls 126 and 128 depicted in FIG. 7).

While the present invention has been illustrated by a description of a few exemplary versions, and while the illustrative versions have been described in considerable detail, it is not the intention of the inventors to restrict or in any way limit the scope of the appended claims to such detail. Additional advantages and modifications will readily appear to those skilled in the art. The invention, in its broader aspects, is therefore not limited to the specific details, representative apparatus and methods, and illustrative examples shown and described. Accordingly, departures may be made from such details without departing from the spirit or scope of the inventors' general inventive concept.

What is claimed is:

1. A barrier system, comprising:

a first barrier and a second barrier, each barrier including:

a top wall;

a bottom wall;

opposed first and second sidewalls; and opposed first and second end walls;

the first sidewall of the first barrier including a first upwardly extending surface and a second upwardly extending surface spaced outwardly from the first upwardly extending surface, the first and second upwardly extending surfaces define a first space therebetween constructed and arranged to releasably receive at least a portion of the top wall of the second barrier when one of the first and second barriers is in an inverted position relative to the other of the first and second barriers, and a portion of the first barrier first sidewall is generally face to face with a portion of the second barrier first sidewall.

2. The barrier system of claim 1 further including a support surface extending between the first and second upwardly extending surfaces.

3. The barrier system of claim 2 wherein the first sidewall includes a first tab, and the first tab includes the second upwardly extending surface.

4. The barrier system of claim 3 further including a third upwardly extending surface spaced outwardly from the first upwardly extending surface, the first and third upwardly extending surfaces define a second space therebetween constructed and arranged to releasably receive at least a portion of the top wall of the second barrier when one of the first and second barriers is in an inverted position relative to the other of the first and second barriers, and a portion of the first barrier first sidewall is generally face to face with a portion of the second barrier fist sidewall.

5. The barrier system of claim 4 further including a support surface extending between the first and third upwardly extending surfaces.

6. The barrier system of claim 5 wherein the first sidewall includes a second tab, and the second tab includes the third upwardly extending surface.

7. The barrier system of claim 6 wherein the third upwardly extending surface is substantially parallel with the second upwardly extending surface.

8. The barrier system of claim 7 wherein each of the first and second spaces has a width, and the portion of the top wall of the second barrier has a width substantially similar to that of the first and second spaces.

9. The barrier system of claim 1 wherein the first sidewall of the second barrier includes a first upwardly extending surface and a second upwardly extending surface spaced outwardly from the first upwardly extending surface, the first and second upwardly extending surfaces of the second barrier first sidewall define a first space therebetween constructed and arranged to releasably receive at least a portion of the top wall of the first barrier when one of the first and second barriers is in an inverted position relative to the other of the first and second barriers, and a portion of the first barrier first sidewall is generally face to face with a portion of the second barrier first sidewall.

10. The barrier system of claim 9 further including a support surface extending between the first and second upwardly extending surfaces of the second barrier first sidewall.

11. The barrier system of claim 9 wherein the second barrier first sidewall includes a first tab, and the first tab includes the second upwardly extending surface.

12. The barrier system of claim 9 wherein the second barrier first space has a width, and the portion of the top wall of the first barrier has a width substantially similar to that of the second barrier first space.

13. The barrier system of claim 1 further including a third upwardly extending surface spaced outwardly from the first upwardly extending surface, the first and third upwardly extending surfaces define a second space therebetween constructed and arranged to releasably receive at least a portion of the top wall of the second barrier when one of the first and second barriers is in an inverted position relative to the other of the first and second barriers, and a portion of the first barrier first sidewall is generally face to face with a portion of the second barrier first sidewall.

14. The barrier system of claim 13 further including a support surface extending between the first and second upwardly extending surfaces, and a support surface extending between the first and third upwardly extending surfaces.

15. The barrier system of claim 13 wherein the first sidewall includes a first tab and a second tab, the first tab including the second upwardly extending surface, and the second tab including the third upwardly extending surface.

16. The barrier system of claim 13 wherein the third upwardly extending surface is substantially parallel with the second upwardly extending surface.

17. The barrier system of claim 13 wherein each of the first and second spaces has a width, and the portion of the top wall of the second barrier has a width substantially similar to that of the first and second spaces.

18. The barrier system of claim 1 wherein the first space has a width, and the portion of the top wall of the second barrier has a width substantially similar to that of the first space.

19. The barrier system of claim 1 wherein the first sidewall includes a step, with the first and second upwardly extending surfaces being recessed in the step, thereby forming a slot.

20. The barrier system of claim 1 wherein the first barrier comprises a first part releasably connectable to a second part, the first part including the bottom wall and a lower portion of the sidewalls and end walls, and the second part including the top wall and an upper portion of the sidewalls and end walls.

21. The barrier system of claim 1 wherein the first barrier further includes first connecting structure at one of the first barrier first and second end walls, and the second barrier further includes second connecting sure at one of the second barrier first and second end walls, the first and second connecting structures constructed and arranged to facilitate releasable connection of the first barrier and the second barrier.

22. The barrier system of claim 21 wherein the first and second connecting structures include a plurality of loop connectors.

23. The barrier system of claim 22 in combination with a hinge pin, the hinge pin operable to releasably connect the first and second connecting structures to each other.

24. The barrier system of claim 22 in combination with a wall mounting bracket, the wall mounting bracket including a plurality of loop connectors or posts construed and arranged to facilitate releasable connection of the first barrier or the second barrier to a wall.

25. The barrier system of claim 21 wherein the first sidewall of the first barrier includes a beveled section adjacent the bottom wall and one of the first and second end walls, the beveled section facilitating formation of an angle of less than 180° between the first and second barriers when the first and second connecting structures are arranged for releasable connection of the first barrier and the second barrier.

26. The barrier system of claim 1 wherein the fist barrier includes a height defined by a distance between the bottom wall and the top wall, the first barrier further including a plurality of vertically elongated openings, with each of the openings extending transversely from the first sidewall to the second sidewall, and each of the openings including a height defined by an upper end and a lower end, the height of each of the openings being at least about one third the height of the first barrier.

27. The barrier system of claim 1 wherein the first barrier further includes a wheel at the bottom wall adjacent one of the first and second end walls, the wheel operable to facilitate movement of the first barrier from one location to another.

28. The barrier system of claim 27 wherein the first barrier further includes a handle at the other of the first and second end walls, whereby a user may elevate the other of the first and second end walls, and move the first barrier from one location to another while grasping the handle.

29. The barrier system of claim 1 wherein the first barrier is a barrier unit.

30. The barrier system of claim 1 wherein the first barrier is a gate unit.

31. A first barrier for use with a second barrier that includes a top wall, a bottom wall, opposed first and second sidewalls, and opposed first and second end walls, the first barrier comprising:

a top wall;

a bottom wall;

opposed first and second sidewalls; and opposed first and second end walls;

the first sidewall of the first barrier including a first upwardly extending surface and a second upwardly extending surface spaced outwardly from the first upwardly extending surface, the first and second upwardly extending surfaces define a first space therebetween constructed and arranged to releasably receive at least a portion of a top wall of a second barrier when one of the first barrier and a second barrier is in an inverted position relative to the other of the first barrier and a second barrier, and a portion of the first barrier first sidewall is generally face to face with a portion of a second barrier first sidewall.

32. The first barrier of claim 31 further including a support surface extending between the first and second upwardly extending surfaces.

33. The first barrier of claim 31 further including first connecting structure at one of the first and second end walls, the first connecting structure constructed and arranged to facilitate releasable connection of the first barrier and a second barrier.

* * * * *